US006539753B1

(12) United States Patent
Ito et al.

(10) Patent No.: US 6,539,753 B1
(45) Date of Patent: Apr. 1, 2003

(54) DRUM TYPE WASHING MACHINE

(75) Inventors: Masumi Ito, Seto (JP); Fumitaka Yamazaki, Owariasahi (JP); Shinichiro Kawabata, Seto (JP); Kiyomi Sasano, Ichinomiya (JP); Shuji Hashiba, Ena-gun (JP)

(73) Assignee: Kabushiki Kaisha Toshiba, Kawasaki (JP)

( * ) Notice: Subject to any disclaimer, the term of this patent is extended or adjusted under 35 U.S.C. 154(b) by 0 days.

(21) Appl. No.: 09/701,546

(22) PCT Filed: Mar. 16, 2000

(86) PCT No.: PCT/JP00/01622

§ 371 (c)(1),
(2), (4) Date: Nov. 30, 2000

(87) PCT Pub. No.: WO00/60157

PCT Pub. Date: Oct. 12, 2000

(30) Foreign Application Priority Data

Mar. 31, 1999 (JP) ..... 11-92093
Jun. 3, 1999 (JP) ..... 11-156533

(51) Int. Cl.[7] ..... D06F 37/04

(52) U.S. Cl. ..... 68/3 R; 68/19.2; 68/20; 68/24; 68/140

(58) Field of Search ..... 68/3 R, 19.2, 20, 68/24, 58, 140

(56) References Cited

U.S. PATENT DOCUMENTS 2,302,836 A * 11/1942 Breckenridge et al.
2,309,940 A * 2/1943 Douglas
2,754,670 A * 7/1956 Lawson
2,869,345 A * 1/1959 Strathearn et al.
2,895,320 A * 7/1959 Long
2,910,854 A * 11/1959 Hughes (List continued on next page.)

FOREIGN PATENT DOCUMENTS

| | | |
|---|---|---|
| AU | 200252 | * 11/1955 |
| EP | 716 178 | 6/1996 |
| EP | 780 507 | 6/1997 |
| FR | 1340648 | * 9/1963 |
| FR | 1 340 648 | 10/1963 |
| FR | 1354594 | * 1/1964 |
| GB | 143170 | * 9/1951 |
| GB | 892292 | * 3/1960 |
| IT | 604878 | * 5/1960 |
| JP | 57-064091 | 4/1982 |
| JP | 60-171280 | 11/1985 |
| JP | 64-32893 | * 2/1989 |
| JP | 2-048082 | 4/1990 |
| JP | 3-26293 | * 2/1991 |
| JP | 4-129593 | 4/1992 |
| JP | 9-182369 | 7/1997 |
| JP | 9-308789 | 12/1997 |
| JP | 10-272298 | 10/1998 |

*Primary Examiner*—Frankie L. Stinson
(74) *Attorney, Agent, or Firm*—Pillsbury Winthrop LLP

(57) ABSTRACT

A drum type washing machine includes an outer cabinet (1), a water tub (3) disposed in the cabinet (1), a rotating tub (10) disposed in the water tub (3) so as to be inclined rearwardly downward, and an electric motor (17) of the outer rotor type mounted on a rear wall (26) of the water tub (3) for directly driving the rotating tub (10).

16 Claims, 15 Drawing Sheets

U.S. PATENT DOCUMENTS 2,986,914 A * 6/1961 Brucken
2,990,706 A * 7/1961 Bochan
3,186,104 A * 6/1965 Stilwell
3,194,032 A * 7/1965 Vom Brimer
3,248,908 A * 5/1966 Pope
3,331,141 A * 7/1967 Jacobs et al.
3,387,310 A * 6/1968 Marshall
3,503,228 A * 3/1970 Lake
3,604,222 A * 9/1971 Sandkrug et al.
3,840,764 A * 10/1974 Burger
4,446,706 A * 5/1984 Hartwig
5,074,131 A * 12/1991 Hirose
5,600,976 A * 2/1997 Hapke et al.
5,862,686 A 1/1999 Skrippek
5,881,579 A 3/1999 Ellingson
5,887,456 A 3/1999 Tanigawa et al.
6,282,928 B1 * 9/2001 Fukumoto et al.
6,341,507 B1 * 1/2002 Rode et al.

* cited by examiner

FIG. 8

| | | TIME (MIN.) | MOTOR | WATER-SUPPLY VALVE | DRAIN PUMP | SOLENOID |
|---|---|---|---|---|---|---|
| DETECTION OF CLOTH AMOUNT | | 1 | ○ | | | L |
| WASH | WATER SUPPLY & AGITATION | 1.5 | ◇ | K | | -L |
| | AGITATION (FIRST) | | ◇ | | | -L |
| | AGITATION (SECOND) | 5 | ◇ | | | L |
| | DRAIN & AGITATION | 0.5 | ◇ | | P | L |
| | DEHYDRATION | 4 | ○ | | P | L |
| RINSE 1 | WATER SUPPLY & AGITATION | 4 | ◇ | K | | L |
| | AGITATION | | ◇ | | | L |
| | DRAIN & AGITATION | | ◇ | | P | L |
| | DEHYDRATION | 4 | ○ | | P | L |
| RINSE 2 | WATER SUPPLY & AGITATION | 4 | ◇ | K | | L |
| | AGITATION | | ◇ | | | L |
| | DRAIN & AGITATION | | ◇ | | P | L |
| | DEHYDRATION | 4 | ○ | | P | L |
| RINSE 3 | WATER SUPPLY & AGITATION | 4 | ◇ | K | | L |
| | AGITATION | | ◇ | | | L |
| | DRAIN & AGITATION | | ◇ | | P | L |
| DEHYDRATION | CLOTH DISENTANGLEMENT | 1 | ◇ | | P | L |
| | DETECTION OF UNBALANCED CONDITION | 0.5 | ○ | | P | L |
| | PREPATRATORY DEHYDRATION | 1 | ○ | | P | L |
| | CLOTH DISENTANGLEMENT | 1 | ◇ | | P | L |
| | DETECTION OF UNBALANCED CONDITION | 0.5 | ○ | | P | L |
| | FINAL DEHYDRATION | 6 | ○ | | P | L |

Tr (○:ONE-WAY ENERGIZATION ◇:BIDIRECTIONAL ENERGIZATION
K:WATER SUPPLY P:DRAIN L:LOCKING -L:UNLOCKING)

DRUM TYPE WASHING MACHINE

TECHNICAL FIELD

This invention relates to a drum type washing machine including a rotating tub inclined rearwardly downward.

BACKGROUND ART

FIG. 17 illustrates one of conventional drum type washing machines. The illustrated washing machine comprises an outer cabinet 201 and a water tub 202 elastically supported by a plurality of suspension mechanisms 203 in the cabinet. A rotating tub 204 is rotatably mounted in the water tub 202. A bearing housing 206 is mounted on the rear of the water tub 202. The rotating tub 204 has a rotational shaft 205 supported on a bearing 207 housed in the bearing housing 206.

An electric motor 209 is provided below the water tub 202. A driven pulley 208 is mounted on the rotational shaft 205 of the rotating tub 204. A driving pulley 210 is mounted on a rotational shaft 209*a* of the motor 209. A transmission belt 212 extends between the pulleys 208 and 210. The driven pulley 208, the driving pulley 210 and the transmission belt 212 constitute a belt transmission mechanism 211. In this construction, torque developed by the motor 209 is transmitted via the belt transmission mechanism 211 to the rotating tub 204, whereby the rotating tub is rotated.

Household drum type washing machines are usually installed on a floor. A user bends his or her knees to put and take laundry into and out of the rotating tub. The prior art has proposed a drum type washing machine with a rotating tub inclined rearwardly downward so that the interior of the rotating tub can easily be viewed when laundry is put into and taken out of the rotating tub. However, the following problems result from this construction. That is, laundry moves to a deep interior of the rotating tub when it is rotated. As a result, an amount of vibration or oscillation produced during rotation of the rotating tub is increased.

The belt transmission mechanism particularly tends to produce vibration for the reason that the driving pulley slips during high-speed rotation or for other reasons. Accordingly, when the rotating tub is inclined rearwardly downward, the vibration produced by the rotating tub is further increased. Further, the water tub swings upon vibration of the rotating tub. To prevent collision of the water tub against the outer cabinet, a sufficient distance needs to be ensured between the water tub and the cabinet. For this purpose, the size of the cabinet needs to be increased when a large amount of vibration is produced from the rotating tub.

Therefore, an object of the present invention is to provide a drum type washing machine which includes a rotating tub inclined rearwardly downward for improvement in the easiness of access to the rotating tub and can yet reduce an amount of vibration.

DISCLOSURE OF THE INVENTION

The present invention provides a drum type washing machine comprising an outer cabinet including a front further including a front panel having a laundry access opening and a door provided on the front panel to close and open the access opening, the front of the cabinet being inclined at an angle relative to a vertical axis, a water tub provided in the cabinet, a rotating tub provided in the water tub so as to be inclined rearwardly downward so that the inclination angle of the front of the cabinet is smaller than an inclination angle of a front of the rotating tub relative to the vertical axis and an electric motor provided on a rear wall of the water tub for directly driving the rotating tub.

According to the above-described construction, the efficiency in the access to the rotating tub or in putting or taking laundry into and out of the rotating tub can be improved since the rotating tub is inclined rearwardly downward can be restrained. Further, the inclination of the front of the rotating tub can be set so that the laundry is readily put into and taken out of the rotating tub, and the inclination of the front of the cabinet can be set so that an increase in the size of the cabinet is prevented. Additionally, the door can be prevented from being inadvertently closed in the open state. Further, since the rotating tub is directly driven by the motor, an increase in the amount of vibration or noise produced during rotation of the rotating tub due to the provision of the rotating tub inclined rearwardly downward.

The motor is preferably of an outer rotor type. An outer rotor type motor has a smaller axial dimension and develops a higher torque than an inner rotor type motor. Accordingly, an increase in a back-and-forth dimension of the outer cabinet can be limited when the outer rotor type motor is provided on the rear wall of the water tub.

The rotating tub preferably has an axis of rotation inclined in an angular range between 10 and 20 degrees relative to a horizontal axis. Consequently, since the interior of the rotating tub can be viewed widely from the front area to the deep interior, the efficiency in the access to the rotating tub can further be improved.

The outer cabinet preferably has an access opening formed in a front wall thereof. The drum type washing machine further comprises a door for closing and opening the access opening of the cabinet, a door-opening operation detecting element detecting an operation for opening the door and a control element stopping the motor by means of electric braking, the control element stopping the motor when a detecting operation has been carried out by the door-opening operation detecting element. The motor is braked on the basis of any door-opening operation effected by another previously performed operation. Consequently, since the rotating tub is stopped in a short time from the time of an actual opening of the door, the safety can be improved. Particularly when the rotating tub is directly driven by the motor, the motor can be stopped in a shorter time by the electrical braking than by the mechanical braking. This further improves the safety.

The outer cabinet preferably has an access opening formed in a front wall thereof. The drum type washing machine further comprises an operation control element controlling a washing operation, and a switch indicative of execution of the washing operation. The operation control element prohibits the washing operation until the switch is operated when the door has been opened after start of the washing operation. When the door is opened after start of the washing operation, it is not restarted until the switch is operated and execution of the washing operation is instructed. Consequently, an inadvertent rotation of the rotating tub can be prevented and accordingly, the safety can be improved.

The invention also provides a drum type washing machine comprising an outer cabinet, a water tub provided in the cabinet so as to be inclined rearwardly downward, the water tub having a rear wall, a rotating tub provided in the water tub so as to be inclined rearwardly downward, an electric motor provided on the rear wall of the water tub for directly driving the rotating tub, and a dryer provided for drying laundry in the rotating tub and including a blower disposed at a back of the upper rear wall of the water tub in the cabinet. In this construction, the water tub is inclined rearwardly downward and the blower is disposed at the back of an upper rear wall of the water tub in the cabinet. When the water tub is inclined rearwardly downward as well as the rotating tub, a dead space results from the construction at the back of the upper rear wall of the water tub in the cabinet. Since the blower is disposed at the back of the upper rear wall of the water tub, the dead space can effectively be used.

The water tub is preferably inclined rearwardly downward. In this construction, the drum type washing machine further comprises a drain pump for draining the water tub, the drain pump being disposed below a front lower portion of the water tub in the cabinet. When the water tub is inclined rearwardly downward as well as the rotating tub, a dead space results from the construction at the back of the lower rear wall of the water tub in the cabinet. Since the drain pump is disposed at the back of the lower rear wall of the water tub, the dead space can effectively be used.

The front panel of the cabinet has a smaller inclination than the front of the rotating tub relative to a vertical axis. Consequently, the outer cabinet can be prevented from an increase in the back-and-forth dimension thereof.

The front of the rotating tub has an inclination ranging between 5 and 20 degrees and the front of the cabinet has an inclination set so as to be smaller than an inclination of the rotating tub by or above 2 degrees and so as to range between 3 and 15 degrees. Consequently, the outer cabinet can be prevented from an increase in the back-and-forth dimension thereof with an efficiency in the work for putting and taking the laundry into and taking out of the rotating tub.

The front panel of the cabinet preferably includes a portion located lower than the access opening and formed into a vertical face. Consequently, an increase in the back-and-forth dimension of the lower portion of the outer cabinet can particularly be prevented.

The invention further provides a drum type washing machine comprising an outer cabinet having a front including a front panel having a laundry access opening and a door provided on the front panel to close and open the access opening, the front of the cabinet being inclined at an angle relative to a vertical axis, a water tub provided in the cabinet, a rotating tub provided in the water tub so as to be inclined rearwardly downward so that the inclination angle of the front of the cabinet is smaller than an inclination angle of a front of the rotating tub relative to the vertical axis, and an electric motor driving the rotating tub. Since no special parts are required for the air supply port, the construction of the washing machine can be simplified.

The drum type washing machine preferably further comprises bellows connecting laundry access opening and an opening of the water tub and a dryer for drying laundry in the rotating tub, the dryer including a hot air generator for generating hot air. In this construction, the water tub is inclined rearwardly downward and the bellows have an air supply port through which the hot air is supplied from the hot air generator into the rotating tub. Consequently, since no special parts are required for the air supply port, the construction of the washing machine can be simplified.

BRIEF DESCRIPTION OF THE DRAWINGS

FIG. 8 is a time chart showing the contents of operation control;

BEST MODE OF WORKING OF THE INVENTION

Figure 1:
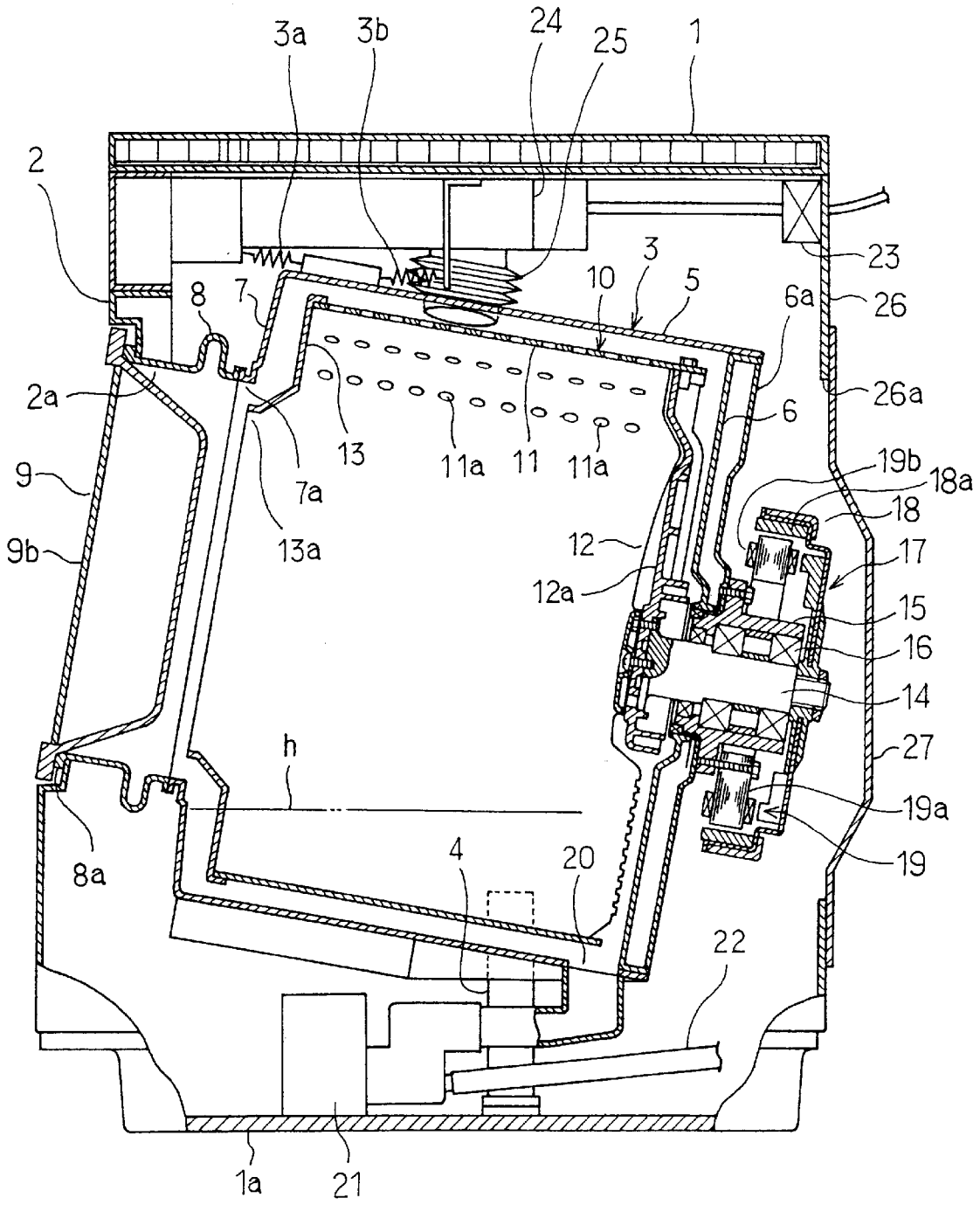
FIG. 1 is a longitudinally sectional side view of the drum type washing machine of a first embodiment in accordance with the present invention.

Several embodiments of the present invention will be described. FIGS. 1 to 10 illustrate a first embodiment in accordance with the present invention. Referring to FIG. 1, a drum type washing machine of the embodiment comprises an outer cabinet 1 formed into the shape of a generally rectangular box. The cabinet 1 includes a front panel 2 having a circular access opening 2*a* through which laundry is put into and taken out of a rotating tub 10. A door 9 closing and opening the access opening 2*a* is mounted on the front panel 2 of the cabinet 1. The door 9 is formed into a circular shape and has a central transparent portion 9*b* made of glass, for example. The front panel 2 and the door 9 constitute a front of the cabinet 1. A water tub 3 is provided in the cabinet 1 so as to be inclined rearwardly downward. The water tub 3 is elastically supported by a pair of suspension mechanisms 4 only one of which is shown in FIG. 1. Two springs 3*a* and 3*b* are provided on an upper portion of the water tub 3. The springs 3*a* and 3*b* limit a back-and-forth swing of the water tub 3.

The water tub 3 comprises a cylindrical body 5, a rear end plate 6 and a front end plate 7. Each of the body 5 and rear and front end plates 6 and 7 is made of a metal plate, for example. The front end plate 7 has a circular opening 7*a*. Bellows 8 made of rubber, for example connect the opening 7*a* to the access opening 2*a* of the cabinet 1. When the access opening 2*a* is closed by the door 9, a front circumferential edge 8*a* of the bellows 8 is located between the circumferential edge of the access opening 2*a* and the door 9. Accordingly, the door 9 provides a watertight closing for the access opening 2*a*. A reinforcing plate 6*a* is mounted on the rear end plate 6 so as to be disposed at the back of the rear end plate.

A rotating tub 10 is provided in the water tub 3 for rotation and comprises a cylindrical body 11, a rear end plate 12 and a front end plate 13. The rotating tub 10 is also disposed to be inclined rearwardly downward according to the water tub 3. The body 11 has a number of small holes 11*a* through which both air and water flow. The body 11 also has a plurality of baffles (not shown) on an inner circumferential surface thereof. The front end plate 13 has a circular opening 13*a*. The rear end plate 12 has a number of holes (not shown). A rotating tub support 12*a* made of a metal, for example, is secured to a backside of the rear end plate 12. The support 12*a* has a larger thickness than the rear end plate 12 and is formed with a plurality of vent holes.

A rotating tub shaft 14 is secured to a portion of the rear of the support 12*a* corresponding to a generally center of the rear end plate 12. A bearing housing 15 made by casting is fixed to the rear end plate 6 and a reinforcing plate 6*a*. The bearing housing 15 has a front end extending through the rear end plate 6 and the reinforcing plate 6*a*. For example, two bearings 16 are provided in the bearing housing 15. The rotating tub shaft 14 is rotatably supported on the bearings 16.

A stator 19 constituting an outer rotor type brushless motor 17 is fixed to an outer circumference of the bearing housing 15. The stator 19 comprises a stator core and coils wound on the stator core. A rotor 18 also constituting the brushless motor 17 is fixed to the rear end of the shaft 14. The rotor 18 comprises permanent magnets 18*a* opposed to the stator 19. Thus, the rotating tub 10 is directly rotated by the motor 17. The rotating tub 10 has an axis of rotation inclined rearwardly downward relative to a horizontal axis. In this case, the axis of rotation of the rotating tub 10 has an inclination ranging between 10 and 20 degrees relative to the horizontal axis.

Figure 9A:
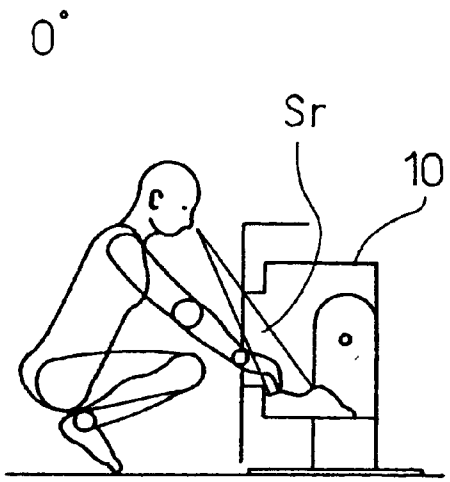
FIGS. 9A, 9B and 9C are diagrammatic views showing relations between an inclination of the rotating tub and a visual field when the inclination is 0, 10 and 22 degrees, respectively.
Figure 9B:
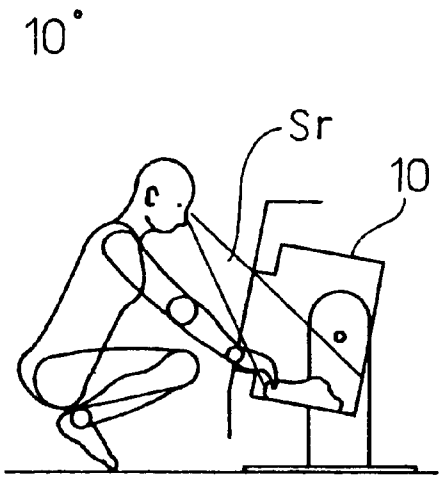
Figure 9C:
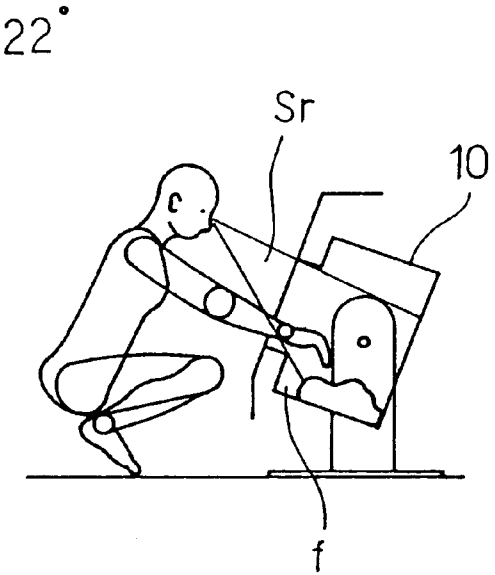

The reason for the above-described range of the inclination of the rotating tub 10 will now be described with reference to FIGS. 9A to 10. FIGS. 9A, 9B and 9C show visual fields Sr in the rotating tub 10 when the inclination of the tub is 0, 10 and 22 degrees respectively. As shown in FIG. 9A, when the inclination of the tub 10 is 0 degrees, the visual field Sr is small such that the user cannot sufficiently look into the inner part of the interior of the tub 10. However, when the rotating tub 10 is inclined rearwardly downward, the visual field Sr is increased with the increase in the inclination of the tub. An experiment carried out by the inventors shows that the visual field Sr is suitably enlarged when the inclination of the tub 10 exceeds 10 degrees, as shown in FIG. 9B. When the inclination exceeds 20 degrees, the user cannot sufficiently look into the front interior as designated by symbol f although the visual field Sr is large, as shown in FIG. 9C. Further, when the inclination of the tub 10 is large, the depth and the height of the tub are increased such that the size of the outer cabinet 1 is increased.

Figure 10:
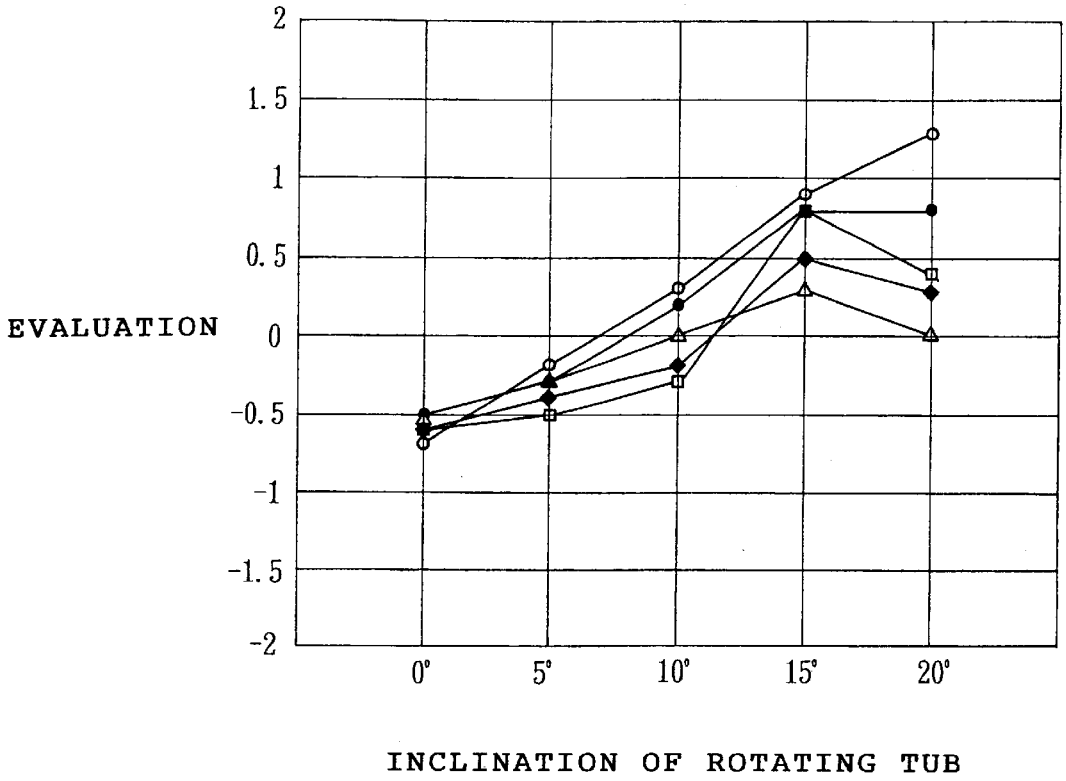
FIG. 10 is a graph showing the relationship between the inclination of the rotating tub and the evaluation of easiness of access to the rotating tub etc.

FIG. 10 shows the relationship between the inclination of the rotating tub 10 and the evaluation of easiness of access to the rotating tub 10. The axis of abscissas shows the inclination of the tub and the axis of ordinates shows evaluation. The evaluation was obtained from the results of questionnaire about five items, that is, "easiness to put laundry into the tub (first item)," "easiness to take laundry out of the tub (second item)," "easiness to take laundry out of a corner (third item)," "easiness to look into the tub (fourth item)" and "over-all judgment (fifth item)." A larger value shows a higher evaluation. The value of 0 means that it is neither good nor bad.

Larger values are set on all the items when the inclination ranges between 5 and 20 degrees that when it is 0 degrees. Particularly when the inclination is 10 degrees, the evaluation is at or above 0 regarding each of three of the five items. Regarding each of the second, third and fifth items, the evaluation is lower when the inclination is 20 degrees than when the inclination is 15 degrees. However, the evaluation is higher when the inclination is 20 degrees than when the inclination is 0 degrees. In view of the results, the inclination of the rotating tub 10 is set to range between 10 and 20 degrees. For example, the inclination of the tub 10 is set at 10 degrees in the embodiment. Further, the water tub 3 is inclined substantially at the same angle relative to the horizontal axis as the rotating tub 10.

With inclination of the water tub 3 and the rotating tub 10, the front end plates 7 and 13 of the respective tubs are inclined relative to a vertical axis. The door 9 is inclined with the same inclination as the front end plates 7 and 13 in the embodiment. The circumferential edge and right and left sides of the access opening 2*a* are also inclined, whereas the other portion of the front panel 2 is vertical.

The water tub 3 has a drain hole 20 formed in the rear bottom thereof. A drain pump 21 is provided on the front of the bottom 1*a* of the cabinet 1. Inclining the water tub 3 rearwardly downward results in a dead space below the lower front of the water tub 3 in the interior of the cabinet 1. The drain pump 21 is disposed in the dead space. Further, the drain hole 20 is connected to an inlet of the drain pump 21. An outlet of the drain pump 21 is connected to a flexible drain hose 22. The drain hose 22 includes a middle portion (not shown) located higher than a set maximum water level in the water tub 3.

A water supply vessel 24 is provided in the upper interior of the cabinet 1. The water supply vessel 24 includes a water supply valve 23 for supplying water into the water tub 3 and a detergent dispensing case 50. The water supply valve 23 is connected to the water supply vessel 24. A flexible hose 25 connects the water supply vessel 24 to the water tub 3. A rear panel 26 serving as a rear of the cabinet 1 has an inspection opening 26*a* formed to be opposite to the motor 17. The inspection opening 26*a* is closed by a detachable lid 27.

Figure 2:
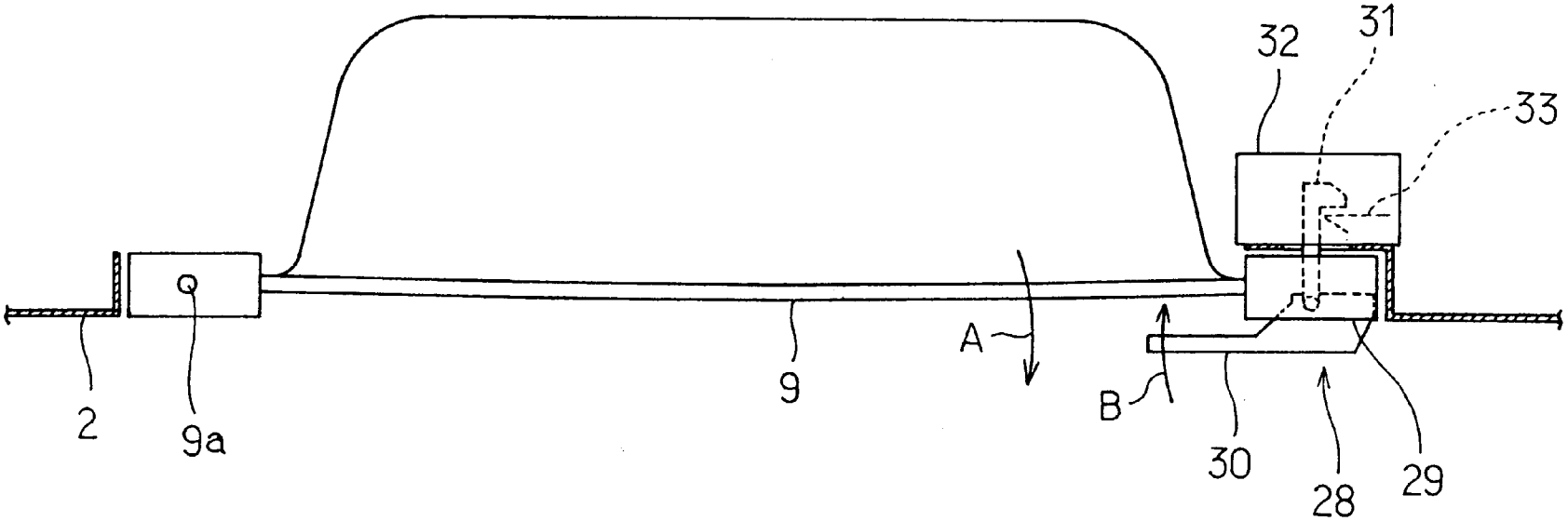
FIG. 2 is a transversely sectional plan view of a part of the outer cabinet around the door.

A locking device 28 will now be described with reference to FIGS. 2 to 6. The locking device 28 serves as a locking element which locks the door 9 in the closed state. Referring to FIG. 2, the door 9 is mounted via a hinge 9*a* on the front panel 2 of the cabinet 1 so as to be turned in the direction of arrow A and in the direction opposite arrow A. A knobbed case 29 is attached to a portion of the door 9 opposed to the hinge 9*a*. The knobbed case 29 includes a rotatable knob 30 and an engagement claw 31 rotated with the knob 30. A spring 30*a* usually urges the knob 30 and the claw 31 in the direction of arrow B.

Figure 3:
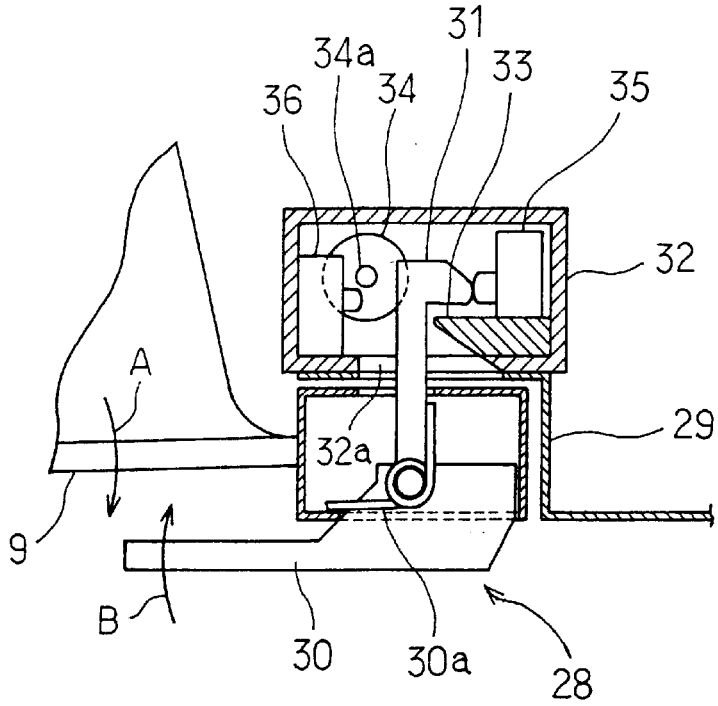
FIG. 3 is a transversely sectional plan view of a locking device, showing the closed state of the door.

A lock case 32 is provided on a portion of the front panel 2 opposed to the claw 31. A locking section 33 is provided in the lock case 32. The lock case 32 includes a front formed with an opening 32*a* as shown in FIG. 3. When the door 9 is closed, the claw 31 is inserted through the opening 32*a* into the lock case 32, engaging the locking section 33. As a result, the door 9 is locked in the closed state.

Figure 4:
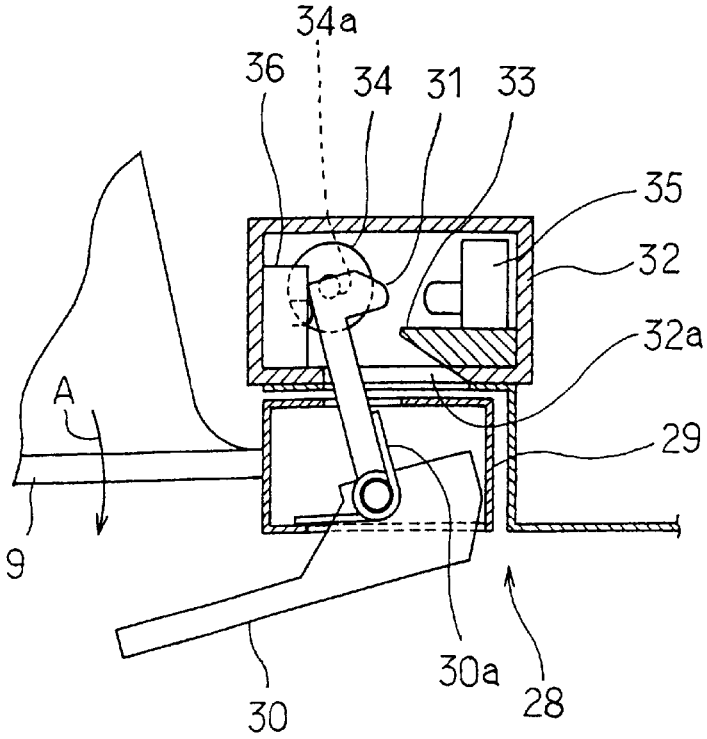
FIG. 4 is a transversely sectional plan view of the locking device, showing a gripping operation.

A door locking solenoid 34 is provided in the lock case 32. The solenoid 34 is disposed so that a plunger 34*a* thereof is located on a movement locus of claw 31 when the solenoid 34 is deenergized. Consequently, the plunger 34*a* prevents the claw 31 from being rotated by such an angle that it is disengaged from the locking section 33, as shown in FIG. 3. When the solenoid 34 is energized, the plunger 34*a* withdraws from the movement locus of the claw 31. As a result, the claw 31 and the knob 30 are allowed to be rotated in the direction opposite arrow B, as shown in FIG. 4. The locking device 28 comprises the knob 30, spring 30*a,* claw 31, locking section and solenoid 34.

Figure 5:
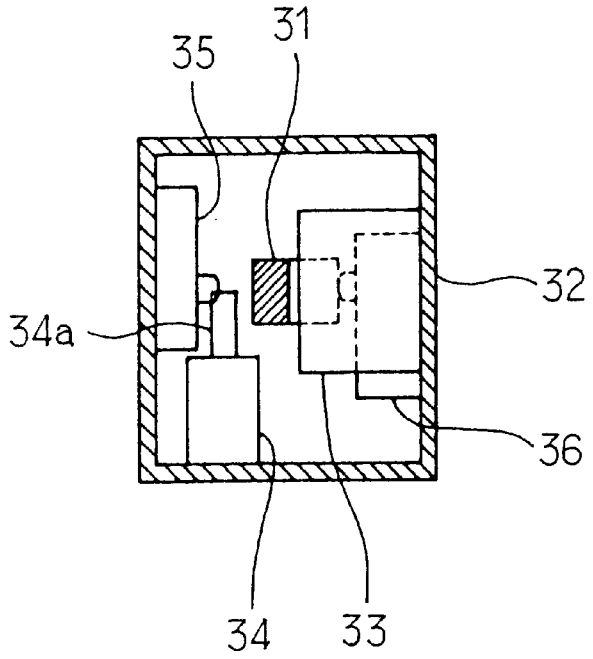
FIG. 5 is a longitudinally sectional front view of the locking device, showing the gripping operation.
Figure 6:
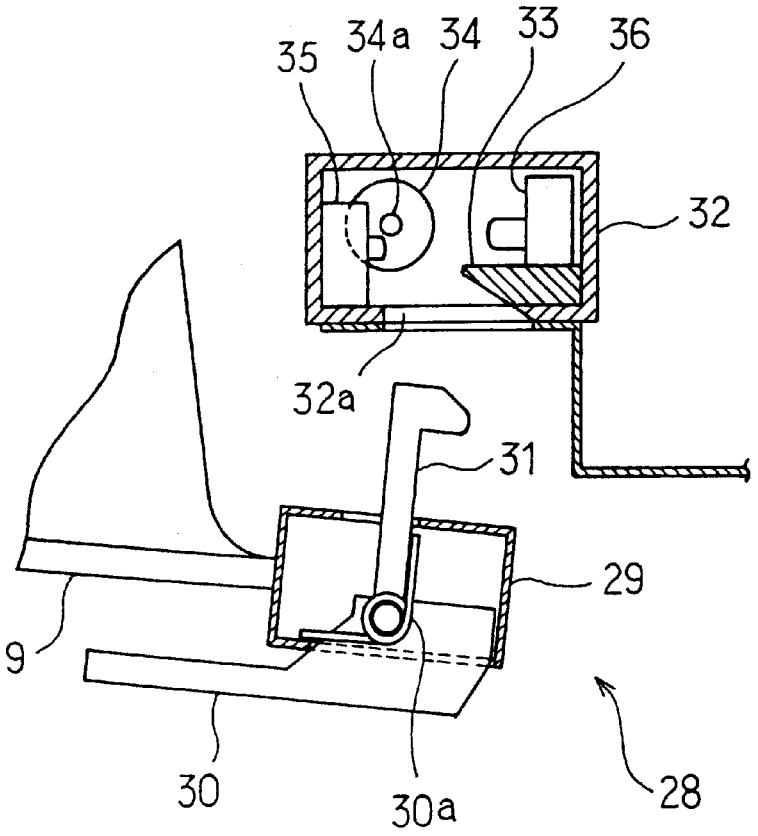
FIG. 6 is a transversely sectional plan view of the locking device, showing the open state of the door.

The lock case 32 encloses a first detecting switch 35 and a second detecting switch 36. Both switches deliver respective output signals to a control circuit 44 (see FIG. 7) serving as a controller which will be described later. When the claw 31 is in engagement with the locking section 33, the first detecting switch 35 is turned on, thereby delivering the output signal, as shown in FIGS. 3 and 5. Thus, the first detecting switch constitutes a locked state detecting element. Further, when the knob 30 is rotated in the direction opposite arrow B while the door 9 is closed, the claw 31 is also rotated in the direction opposite arrow B such that it is disengaged from the locking section 33. As a result, the second detecting switch 36 is turned on. When the knob 30 is rotated in the direction of arrow A in this state, the door 9 is opened such that the claw 31 escapes out of the lock case 32 as shown in FIG. 6. In other words, the second detecting switch 36 is turned on based on an operation carried out prior to an operation for opening the door. Accordingly, the second detecting switch 36 constitutes a door-opening operation detecting element detecting the operation for opening the door to deliver an output signal. When the claw 31 escapes from the lock case 32, both of the first and second detecting switches 35 and 36 are turned off. At this time, the control circuit 44 detects the open state of the door 9.

Figure 7:
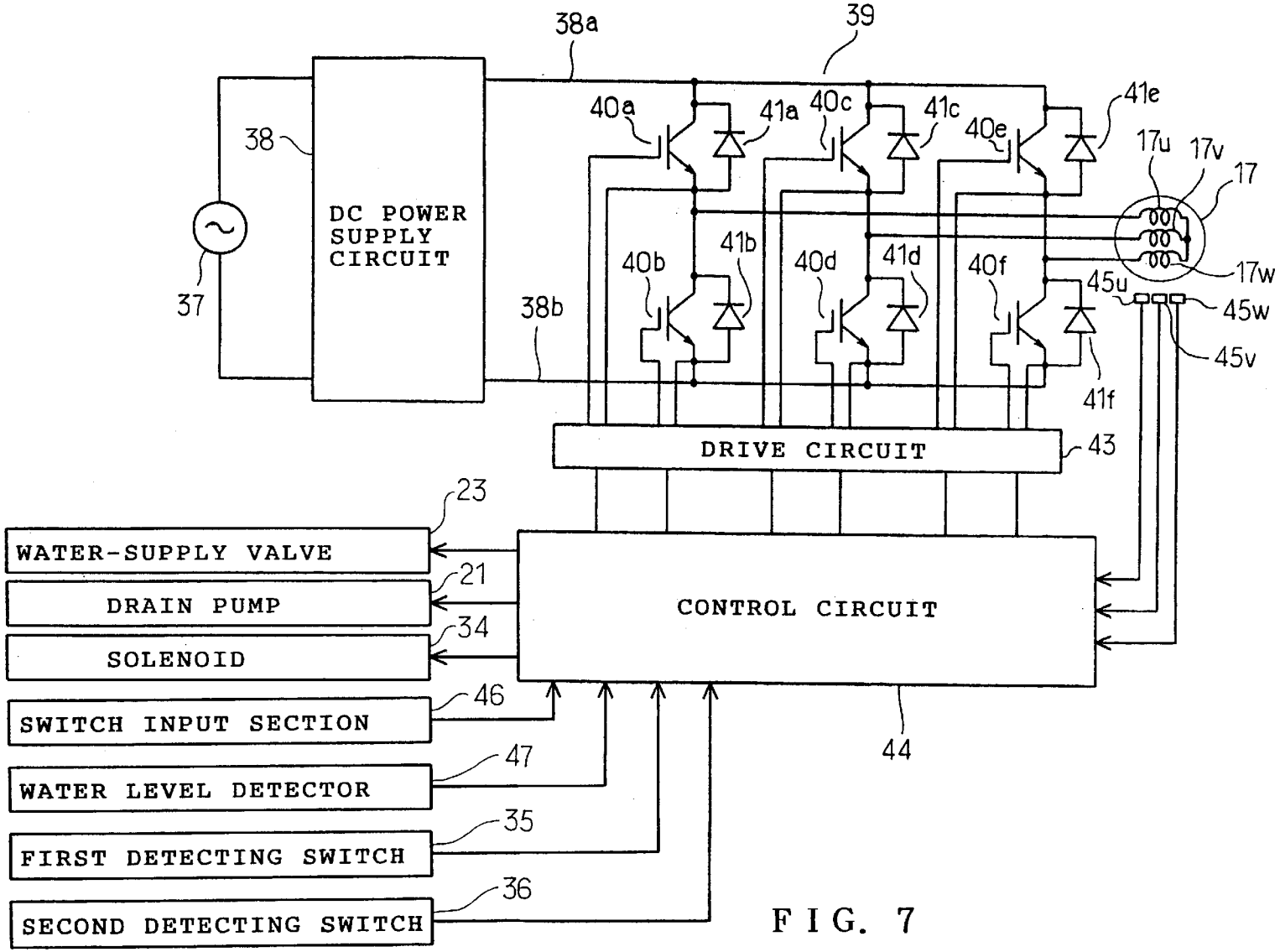
FIG. 7 is a schematic block diagram showing an electrical arrangement of the drum type washing machine.

FIG. 7 shows an electrical arrangement of the drum type washing machine. An AC power supply 37 has both terminals to which a DC power supply circuit 38 is connected. The DC power supply circuit 38 comprises a full-wave rectifier circuit and a smoothing capacitor. The DC power supply circuit 38 has output terminals from which DC buses 38*a* and 38*b* extend. An inverter main circuit 39 is connected to the DC buses 38*a* and 38*b.* The inverter main circuit 39 comprises three-phase bridge-connected switching elements 40*a* to 40*f* such as IGBTs and free-wheel diodes 41*a* to 41*f* connected in parallel with the respective switching elements. The inverter main circuit 39 has output terminals 42*u,* 42*v* and 42*w* connected to three-phase windings 17*u,* 17*v* and 17*w* of the motor 17. The switching elements 40*a* to 40*f* have control terminals (gates) connected to a drive circuit 43 comprising photo-couplers. The drive circuit 43 is connected to a control circuit 44.

The control circuit 44 comprises a microcomputer and stores a control program for controlling an overall operation of the drum type washing machine. Position detection signals delivered from Hall IC's 45*u,* 45*v* and 45*w* serving as position detecting elements for the motor 17 are supplied to the control circuit 44. Based on the supplied position signals and the control program, the control circuit 44 controls the drive circuit 43 to further control the switching elements 40*a* to 40*f* by means of pulse width modulation (PWM), whereupon a voltage applied to and a timing for energization of each of the windings 17*u,* 17*v* and 17*w* are controlled. Further, the control circuit 44 detects a rotational speed of the motor 17 based on the position detection signals.

The detection signals generated by the first and second detecting switches 35 and 36 are also supplied to the control circuit 44 as described above. Further, a switch input section 46 and a water level detecting section 47 deliver an operation signal and a detection signal to the control circuit 44 respectively. Based on the signals delivered from the switch input section 46, water level detecting section 47 and the detecting switches 35 and 36 and the control program, the control circuit 44 controls the water supply valve 23, drain pump 21, solenoid 34, and motor 17. The switch input section 46 includes a power switch, a selecting switch for selecting a suitable washing course, and a start switch for starting and interrupting the washing operation though none of these switches are shown. The water level detecting section 47 detects the water level in the water tub 3.

The operation of the drum type washing machine will now be described. An automatic washing course is selected in the following description. FIG. 8 shows a time chart of the automatic washing course and the operations of the motor 17, water supply valve 23, drain pump 21 and solenoid 34. The automatic washing course includes a laundry amount detecting step, wash step, first rinse step, second rinse step, third rinse step, and dehydrating step. Symbol "○" designates a step where the motor 17 is energized to be rotated in one direction (one-way energization). Symbol "◇" designates a step where the motor 17 is energized to be rotated alternately in both directions (alternate energization). The water supply valve 23 is controlled to carry out the water supplying operation in the step designated by symbol "K." The drain pump 21 is controlled to carry out the draining operation at a step designated by symbol "P." The solenoid 34 is controlled to carry out a locking operation in a step designated by symbol "L" and an unlocking operation in a step designated by symbol "−L."

When the power switch (not shown) is turned on, the control circuit 44 energizes the solenoid 34 for a predetermined time (auto power-off time) to unlock the door. Further, when the start switch is operated during operation, the control circuit 44 energizes the solenoid 34 for the auto power-off time.

The steps of the automatic washing course will now be described:

(1) Laundry Amount Detecting Step

The control circuit 44 deenergizes the solenoid 34 when the first detecting switch 35 is turned on to thereby detect the closed state of the door 9. Consequently, the door 9 is locked in the closed state. Further, the control circuit 44 controls the motor 17 to energize it in a predetermined energization pattern and to deenergize it when the rotational speed of the motor has reached a first predetermined value. The control circuit 44 detects an amount of laundry on the basis of a time required for the speed of the motor 17 to reduce to a second predetermined value.

(2) Wash Step

The wash step includes water-supply & agitation, first and second agitation operation, a drain & agitation operation and a dehydration operation.

(2-1) Water-supply & Agitation

The control circuit 44 energizes the solenoid 34 to release the door 9 from the locked state. Further, the control circuit 44 energizes the motor 17 for rotation in the normal and reverse directions. The control circuit 44 further controls the water-supply valve 23 until the water in the water tub 3 reaches a predetermined level. The water level in the water tub 3 is detected by the water level detecting section 47. In the embodiment, the predetermined water level in the water tub 3 is set to be lower than a portion of the door 9 in contact with the front edge 8*a* of the bellows 8 as shown by two-dot chain line in FIG. 1. Accordingly, leakage of water from the water tub 3 can be prevented. Further, since the rotating tub 10 is disposed to be inclined rearwardly downward, a large amount of water can be reserved deep in the rotating tub 10 even when the water level is set to be lower than the portion of the door 9 in contact with the front edge 8*a* of the bellows 8.

(2-2) First Agitation

The control circuit 44 continuously energizes the solenoid 34 and energizes the motor 17 for normal and reverse rotation. Accordingly, the door 9 is unlocked for initial fifteen minutes of the wash step. This period is referred to as "unlocked period Tr."

(2-3) Second Agitation

The control circuit 44 deenergizes the solenoid 34 to lock the door 9 and energizes the motor 17 for normal and reverse rotation. Thereafter, the door 9 is maintained in the locked state except the case where the start switch is operated, as will be described in detail later.

(2-4) Drain & Agitation

The control circuit 44 energizes the motor 17 for normal and reverse rotation and drives the drain pump 21 so that the water tub 3 is drained.

(2-5) Dehydration

The control circuit 44 energizes the motor 17 so that it is rotated at high speeds in one direction.

(3) First Rinse Step

The first rinse step includes water supply & agitation, agitation, drain & agitation, and dehydration.

(3-1) Water Supply & Agitation

The same operation as in the water supply & agitation in the wash step is carried out with the exception that the door 9 is locked in the closed state by the solenoid 34.

(3-2) Agitation

The same operation as in the second agitation in the wash step is carried out.

(3-3) Drain & Agitation

The same operation as in the drain & agitation in the wash step is carried out.

(3-4) Dehydration

The same operation as in the dehydration in the wash step is carried out.

(4) Second Rinse Step

The same operations as in the first rinse step are carried out.

(5) Third Rinse Step

The same operation as in the first rinse step are carried out with the exception of the dehydration.

(6) Dehydration Step

The dehydration step includes cloth disentanglement, detection of unbalanced condition, preparatory dehydration, cloth disentanglement, detection of unbalanced condition, and final dehydration.

(6-1) Cloth Disentanglement

The control circuit 44 energizes the motor 17 so that the motor is rotated alternately in both directions while driving the drain pump 21, whereby the laundry in the rotating tub 10 is disentangled.

(6-2) Detection of Unbalanced Condition

The control circuit 44 energizes the motor 17 in a predetermined energization pattern while driving the drain pump 21, so that the motor is rotated in one direction. The motor 17 is deenergized after a predetermined speed is reached. The control circuit 44 detects occurrence of the unbalanced condition based on changes in the speeds of the motor 17 in speed rise and fall times. Upon detection of occurrence of the unbalanced condition, substantially the same operation as the aforesaid cloth disentanglement is carried out so that the unbalanced condition is corrected. The control circuit 44 advances to the next operation when occurrence of unbalanced condition is not detected.

(6-3) Preparatory Dehydration

The same operation as in the dehydration in the wash step is carried out.

(6-4) Cloth Disentanglement

The same operation as in (6-1) cloth disentanglement is carried out.

(6-5) Detection of Unbalanced Condition

The same operation as in (6-2) detection of unbalanced condition is carried out.

(6-6) Final Dehydration

The same operation as in the dehydration of (2-5) is carried out.

The above-described steps are sequentially carried out when laundry is put into the rotating tub 10 and the start of the automatic washing course is instructed. Since the door 9 can be opened in an unlocked period Tr without release of the solenoid 34 from the locking operation, additional laundry can easily be put into the rotating tub 10. Further, since the water level in the rotating tub 10 is lower than a place of contact between the bellows 8 and the door 9, the water in the rotating tub 10 can be prevented from flowing out of the access opening 2*a* even when the door 9 is opened in the middle of the wash step. Furthermore, when the knob 30 is rotated in the unlocked period Tr so that the door 9 is opened, the second detecting switch 36 delivers an output signal. Then, the control circuit 44 changes an ON-OFF timing of the switching elements 40*a* to 40*f* so that the current speed of the motor 17 is reduced, a regenerative brake is applied to the motor 17.

Thereafter, the knob 30 is drawn in the direction of arrow A so that the door 9 is opened. Since the motor 17 is being braked in this while, the rotating tub 10 can be stopped in a short period of time after the door is opened. That is, a time period required between the opening of the door 9 and the stop of the rotating tub 10 can be shortened as compared with a case where the braking is started on the basis of the opening of the door 9. Particularly in the case of the direct drive of the rotating tub 10 by the motor 17, an electric braking can stop the tub in a shorter period of time than the mechanical braking such as a band brake. Accordingly, a period of time during which the tub 10 keeps rotating can be shortened when the door 9 is opened during the unlocked period Tr, whereupon the safety can be improved. Furthermore, when the start key which also serves as an interrupt key is operated after expiration of the unlocked period Tr, the control circuit 44 deenergizes the motor 17 and the water-supply valve 23 or the drain pump 21 and energizes the solenoid 34 so that the unlocking operation is carried out. When the knob 30 is rotated in this case, the control circuit 44 applies the regenerative braking to the motor 17.

On the other hand, the door 9 is opened and thereafter closed such that the engagement claw 31 enters the lock case 32 through the opening 32*a*. The claw 31 is then urged by the spring force of the spring 30*a* to thereby engage the locking section 33. Consequently, the first detecting switch 35 delivers the ON signal to the control circuit 44, whereupon the closure of the door 9 is detected. In this case, the control circuit 44 does not re-start the operation until the start switch is operated. In other words, when detecting closure of the door 9, the control circuit 44 re-starts the operation on the basis of the operation of the start switch. As a result, the rotating tub 10 can be prevented from an inadvertent rotation and accordingly, the safety can be improved.

According to the foregoing embodiment, the motor 17 is mounted on the backside of the rear end plate 6 to direct drive the rotating tub 10. This construction eliminates a belt transmission mechanism and can accordingly reduce the vibration. Consequently, even though the tub 10 is inclined rearwardly downward, an increase in the vibration and an increase in the size of the outer cabinet 1 can be restrained. Further, the motor 17 comprises the outer rotor type motor in which an axial dimension can be reduced. Consequently, the increase in the size of the outer cabinet 1 can further be restrained even though the motor 17 is mounted on the backside of the rear end plate 6 of the water tub 3. Additionally, an initial period of 15 minutes in the wash step is set as the unlocking period Tr in which additional laundry can easily be put into the tub 10. Accordingly, at least the second agitation and subsequent operations of the wash step are carried out for the added laundry. Consequently, an insufficiency in the washing period of time for the added laundry can be prevented. Further, since the door 9 is maintained in the closed state after expiration of the unlocking period Tr, an inadvertent addition of laundry can be prevented.

Figure 11:
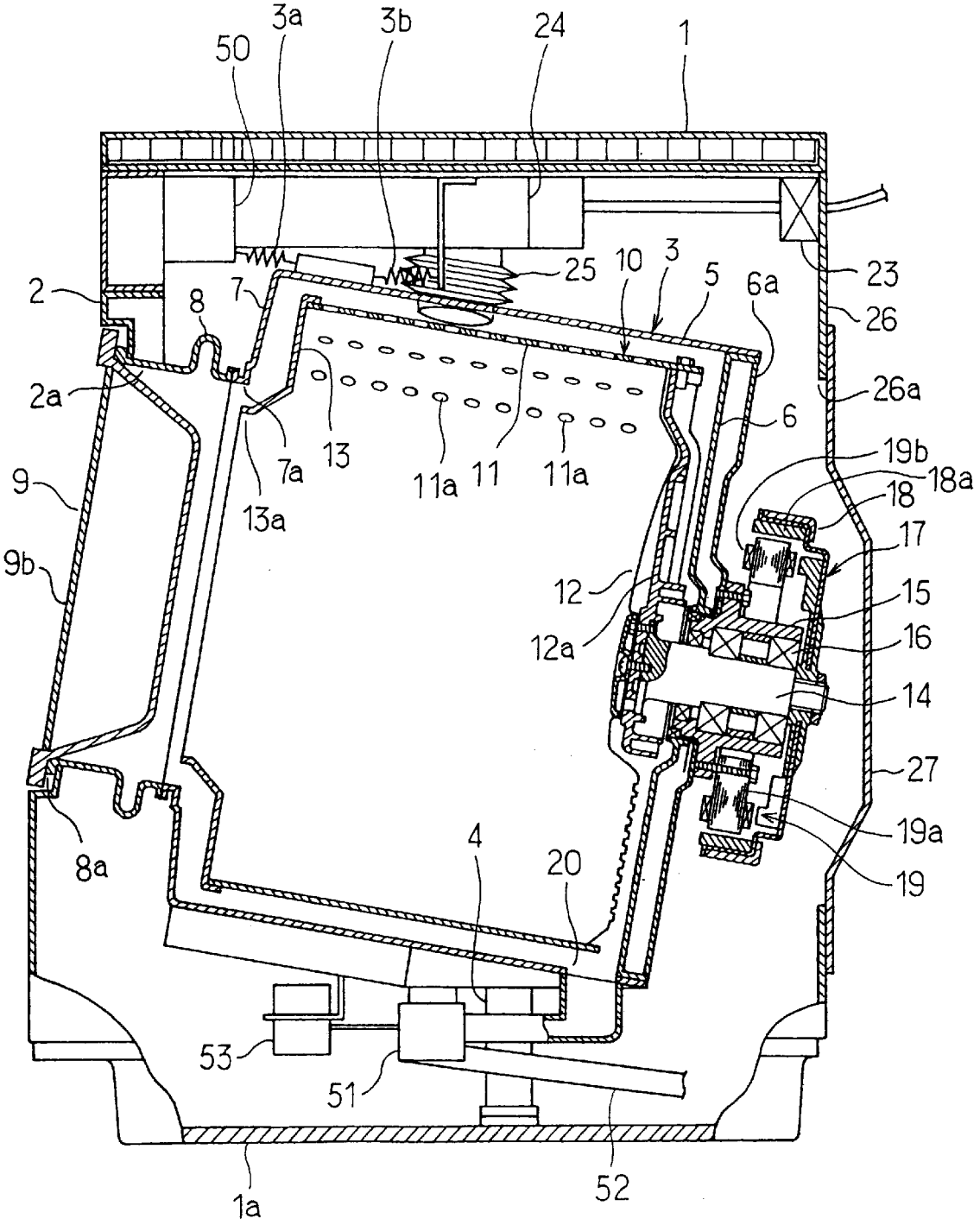
FIG. 11 is a view similar to FIG. 1, showing the drum type washing machine of a second embodiment in accordance with the invention.

FIG. 11 illustrates a second embodiment of the invention. Only the differences between the first and second embodiments will be described. A drain valve 51 is connected to the drain hole 20 in the second embodiment. The drain valve 51 has an outlet to which a drain hose 52 provided below the water tub 3 is connected. A drain valve motor 53 provided below the water tub 3 opens and closes the drain valve 51.

The drain valve motor 53 is disposed in the dead space below the water tub 3 as in the first embodiment. Thus, the dead space can effectively be utilized.

Figure 12:
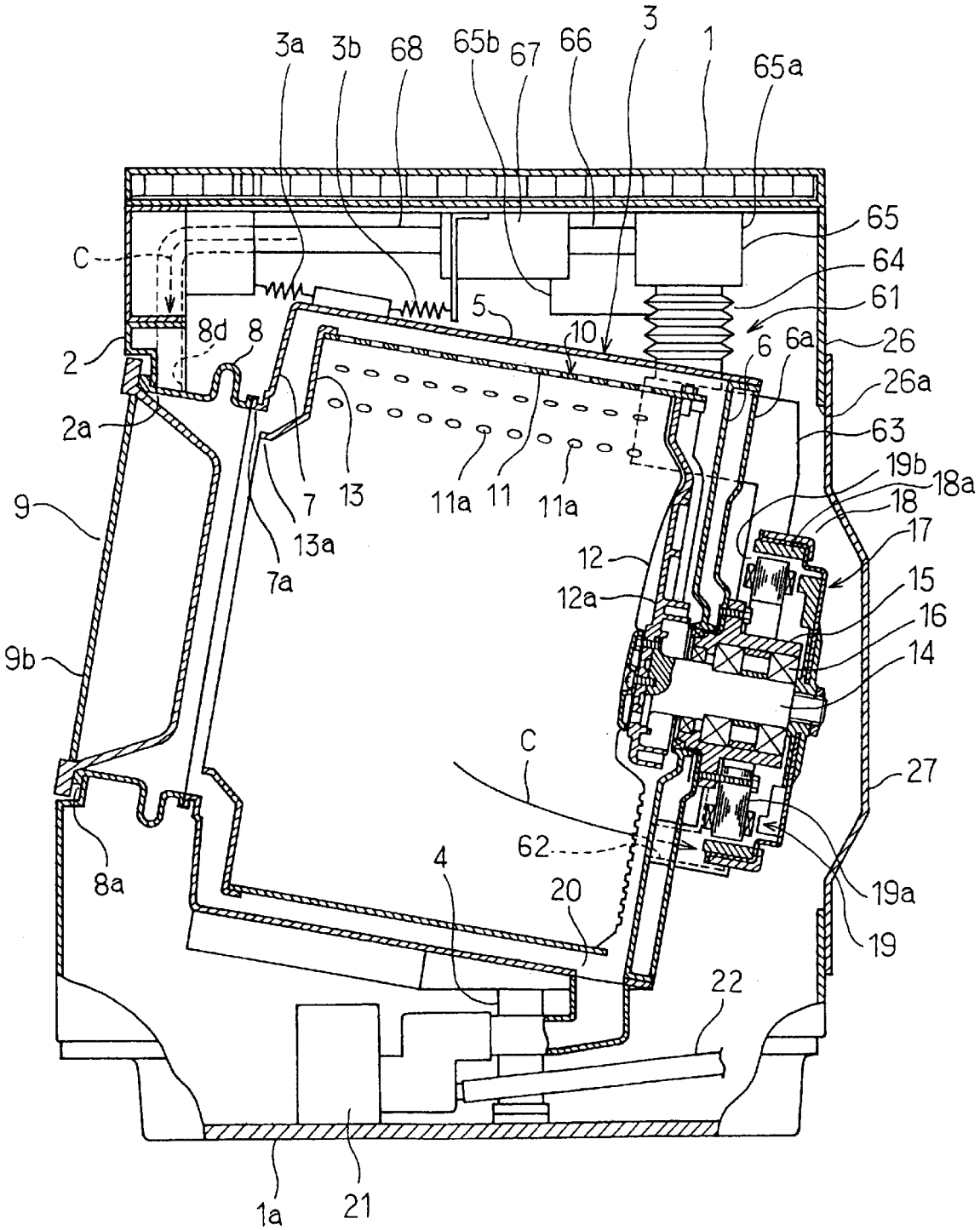
FIG. 12 is a view similar to FIG. 1, showing the drum type washing machine of a third embodiment in accordance with the invention.

FIG. 12 illustrates a third embodiment in which the invention is applied to a drum type washing machine with a drying function. Only the differences between the first and third embodiments will be described. A dryer 61 is provided in the upper interior of the outer cabinet 1 so as to be located on the left of the water tub 3. The dryer 61 includes a heat exchanger 63, a drying fan 65 and a heater 67. The heat exchanger 63 is provided for the heat exchange between outside air and hot air in the tub 10 and disposed at the rear of the water tub 3. The embodiment employs a thin heat exchanger so that an installation space therefor is rendered small. As a result, a distance between the rear of the water tub 3 and the rear plate 26 of the outer cabinet 1 can be reduced and accordingly, an increase in the size of the outer cabinet 1 can be prevented although the drum type washing machine has a drying function.

The rear plate 6 of the water tub 3 has a hot air return port 62 formed therethrough. One of two ends of the heat exchanger 63 is connected to the return port 62. A drying blower 65 comprises a blower casing 65*a* enclosing an impeller (not shown) and a fan motor 65*b*. The fan 65 is disposed on the rear ceiling of the outer casing 1. The other end of the heat exchanger 63 is connected via an accordion connecting duct 64 to a suction side of the fan casing 65*a*. The heater 67 comprises a drying heater (not shown) and is mounted on the ceiling of the outer casing 1 so as to be located in front of the fan 65. The fan casing 65*a* has an exhaust side connected via a duct 66 to the heater 67. The bellows 8 are formed with a hot air exhaust port 8*d* to which the heater 67 is connected via a duct 68.

The rotating tub 10 serves as a drying drum as well as a washing and dehydrating tub in the above-described construction. The dryer 61 is driven in the drying operation so that the fan motor 65*a* is rotated and the drying heater of the heater 67 generates heat. The rotating tub 10 is rotated at a low speed alternately in the normal and reverse directions. Air in the tub 10 is then sucked through the hot air return port 62 into the heat exchanger 63 as shown by arrow C in FIG. 12. The air sucked into the heat exchanger 63 is returned through the connecting duct 64, fan casing 65*a*, duct 66, heater 67, duct 68 and hot air exhaust port 8*d* into the water tub 3, that is, into the rotating tub 10. As the result of the aforesaid air circulation, air in the tub 10 is heated and dehumidified by heat exchange so that laundry in the tub 10 is dried.

The rotating tub 10 and the water tub 3 are inclined rearwardly downward such that a dead space is defined above the water tub 3 in the outer casing 1. The fan 65 and the heater 67 of the dryer 61 is disposed in the dead space in the embodiment. Consequently, an increase in the size of the outer casing 1 can be restrained although the drum type washing machine has a drying function. Since the dead space is relatively large, a large-sized blower with a large blowing capacity can be employed, whereupon an amount of hot air circulated between the interior of the tub 10 and the dryer 61. Consequently, a sufficient drying performance can be achieved even when the temperature of the hot air supplied into the tub 10 for prevention of cloth shrinkage and damage is low. Further, a diameter of the impeller of the fan 65 can be increased. As a result, a rotational speed of the fan motor 65*b* required to obtain a sufficient amount of air can be rendered low and accordingly, a noise reduction can be achieved. The other construction in the third embodiment is the same as in the first embodiment and accordingly, the same effect can be achieved from the third embodiment as from the first embodiment.

Figure 13:
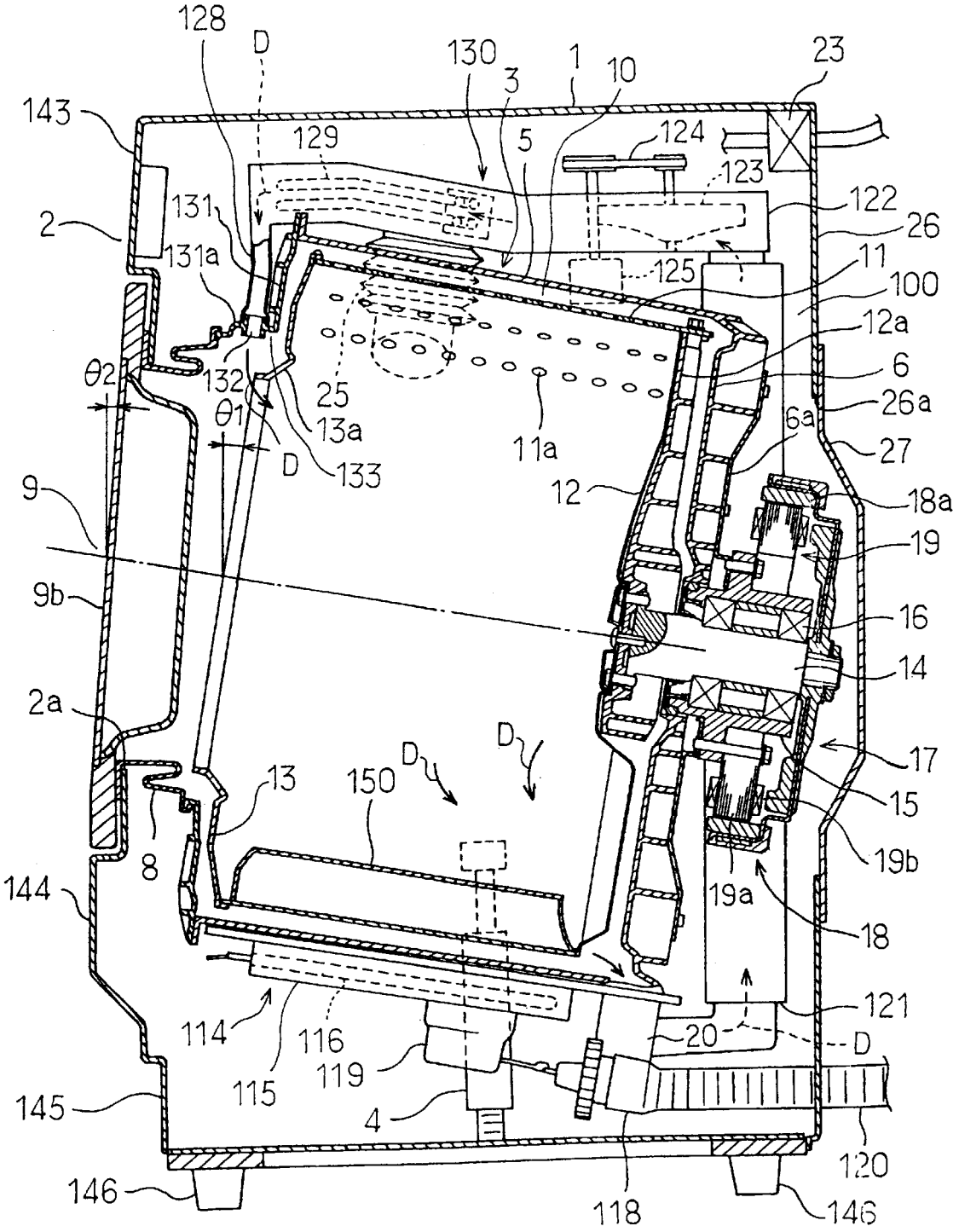
FIG. 13 is a view similar to FIG. 1, showing the drum type washing machine of a fourth embodiment in accordance with the invention.
Figure 14:
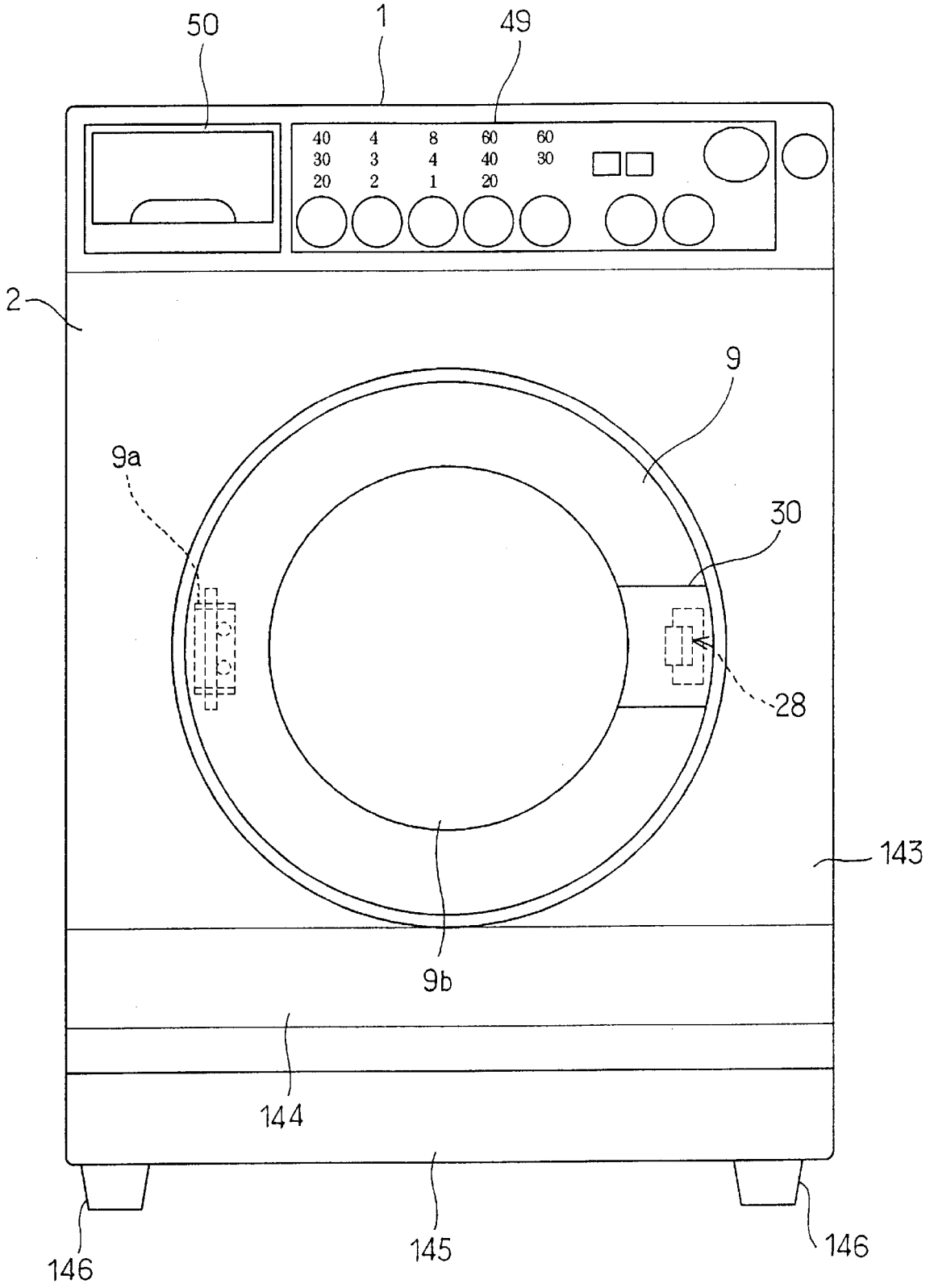
FIG. 14 is a front view of the drum type washing machine.

FIGS. 13 and 14 illustrate a fourth embodiment in which the invention is applied to the drum type washing machine with the drying function. Only the difference between the first and fourth embodiments will be described. Firstly, the door 9 has a smaller inclination than the front end plate 13 of the rotating tub 10. More specifically, reference symbol θ1 in FIG. 13 designates an inclination of the front end plate 13 relative to the vertical face, whereas reference symbol θ2 designates an inclination of the door 9 relative to the vertical face. The inclination of the door 9 is set to be smaller by 2 degrees or more than that of the front end plate 13 and to range between 3 and 15 degrees.

In the embodiment, the inclination θ1 is set at 10 degrees and the inclination θ2 is set at 5 degrees. Further, portions of the front panel 2 on the right and left of the access opening 2*a* and a portion of the front panel 2 above the opening 2*a* are also inclined at an angle of θ2. These portions will be referred to as "inclined face 143." When the door 9 is closed, a front face of the door 9 and the inclined face 143 of the front panel 2 are substantially planar with each other as shown in FIG. 13.

The depth of the outer casing 1 is increased when the inclination θ2 of the front face thereof, that is, the door 9 and the front panel 2 is large. Further, when the door 9 has a large inclination, a component force of the gravity of the door 9, which component force acts on the door 9 in such a direction that the door is closed, becomes large. Accordingly, the door 9 is closed when a relatively small force acts on the opened door 9 in such a direction that the door is closed. In view of this problem, the inclination θ2 of each of the door 9 and the inclined face 143 is set to be smaller by 2 degrees or more than the inclination θ1 of the front end plate 13 and to range between 3 and 15 degrees. This range of the inclination θ2 was obtained from experiments. Consequently, an inadvertent increase in the size of the. outer casing 1 can be restrained and an inadvertent closure of the door 9 can be prevented.

A portion of the front panel 2 located lower than the access opening 2*a* is formed into a substantially vertical face. This portion will be referred to as "vertical face 144." As a result, a dimensional increase in the lower portion of the outer casing 1 in the direction of depth thereof can be restrained. Further, a recess 145 is formed in the lower half of the vertical face 144 so as to extend the entire width. Additionally, for example, four legs 146 are mounted on the underside of the outer casing 1.

Figure 15:
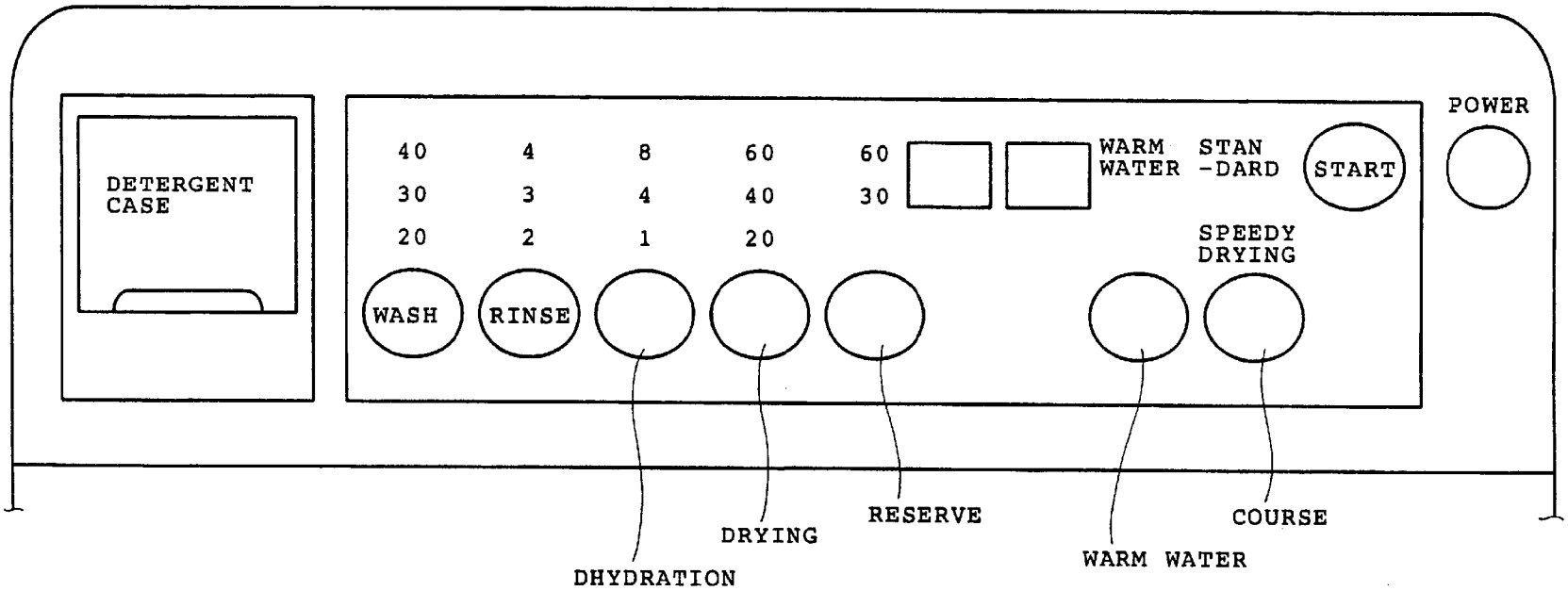
FIG. 15 is an enlarged view of an operation panel of the drum type washing machine.

An operation panel 49 is mounted on an upper portion of the front panel 2 as shown in FIGS. 14 and 15 although not shown in the first embodiment. A front portion of the detergent dispensing case 50 is disposed on the left of the operation panel 49. A plurality of baffles 150 are mounted on the inner circumferential face of the rotating tub 10 as shown in FIG. 13. A water tub cover 131 is mounted on the front end of the body 5 of the water tub 3, instead of the front end plate 7. The water tub cover 131 is made of a heat-resistant material such as a metal plate or a heat-resistant resin. The water tub cover 131 has a central opening 133 and an integrally formed cylindrical portion 131*a* extending slightly upwardly forward from a circumferential edge of the opening 133. The cylindrical portion 131*a* has a width which is maximum at its upper portion and is gradually reduced toward its lower portion. As the result of the construction, a distance between the front end of the cylindrical portion 131*a* and the circumferential edge of the access opening 2*a* is rendered substantially constant over the overall circumference. As a result, the bellows 8 can be disposed between the front end of the cylindrical portion 131*a* and the circumferential edge of the access opening 2*a*. Further, the cylindrical portion 131*a* has a hot air exhaust hole 132 formed through an upper widest portion thereof.

A second heater 114 is provided on the lower outer wall of the water tub 3 as shown in FIG. 13. The heater 114 comprises a casing 115 and a heater 116 enclosed in the casing. The water in the water tub 3 is heated by the heater 116 into hot water. A drain valve 118 is connected to the drain hole 20. A drain hose 120 is connected to an outlet of the drain valve 118. The drain valve 118 is opened and closed by the drain valve motor 119 which is mounted on the underside of the casing 115 of the heater 114. A dryer 100 is provided in the upper interior of the outer cabinet 1 so as to be located on the left of the water tub 3. The dryer 100 includes a heat exchanger 121 and a hot air generator 130. The heat exchanger 121 is disposed in the rear interior of the outer cabinet 1 to be located on the left of the water tub 3. The heat exchanger 121 has a lower end connected to the drain hole 20, whereby the heat exchanger 121 communicates with the interior of the water tub 3. The hot air generator 130 is disposed in the upper interior of the outer cabinet 1 to be located on the left of the water tub 3. The hot air generator 130 comprises a fan 123, a fan motor 125 driving the fan via a belt transmission mechanism 124, and a heater 129. The fan 123 and the heater 129 are enclosed in a casing 122 constituting a hot air passage. The belt transmission mechanism 124 and the motor 125 are disposed outside the casing 122.

The heat exchanger 121 has an upper end connected to a rear end of the casing 122. A front end of the casing 122 is connected via a duct 128 to a hot air exhaust hole 132 of the water tub cover 131. When the fan 123 and the heater 129 are driven during the drying operation, air in the rotating tub 10 is sucked through drain hole 20 into the heat exchanger 121 as shown by arrows D in FIG. 13. The sucked air is returned through the casing 122, duct 128 and hot air exhaust hole 132 into the rotating tub 10. As the result of the above-described air circulation, the air in the tub 10 is heated into hot air and dehumidified by the heat exchange, whereupon the laundry in the tub 10 is dried.

Figure 16:
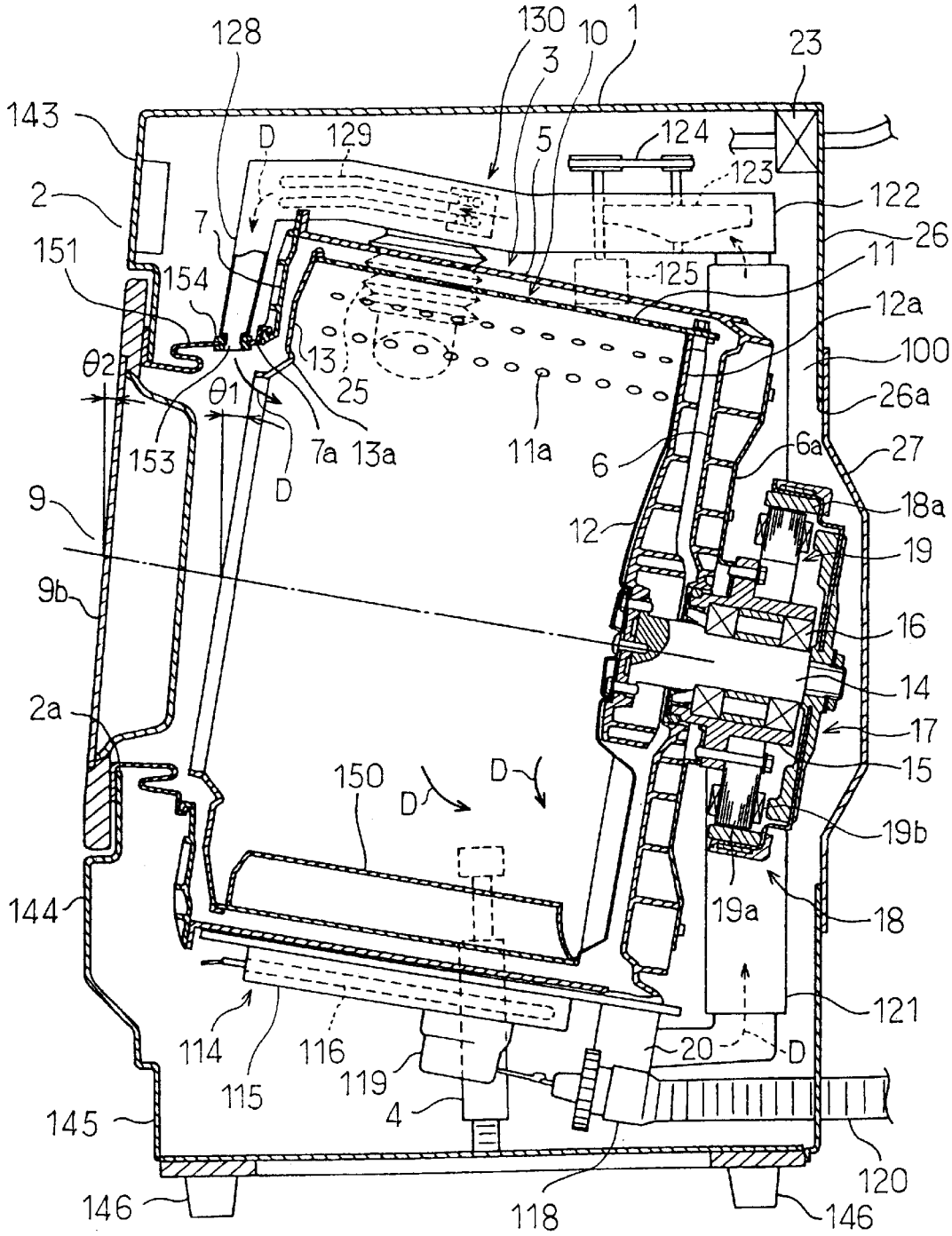
FIG. 16 is a view similar to FIG. 1, showing the drum type washing machine of a fifth embodiment in accordance with the invention.
Figure 17:
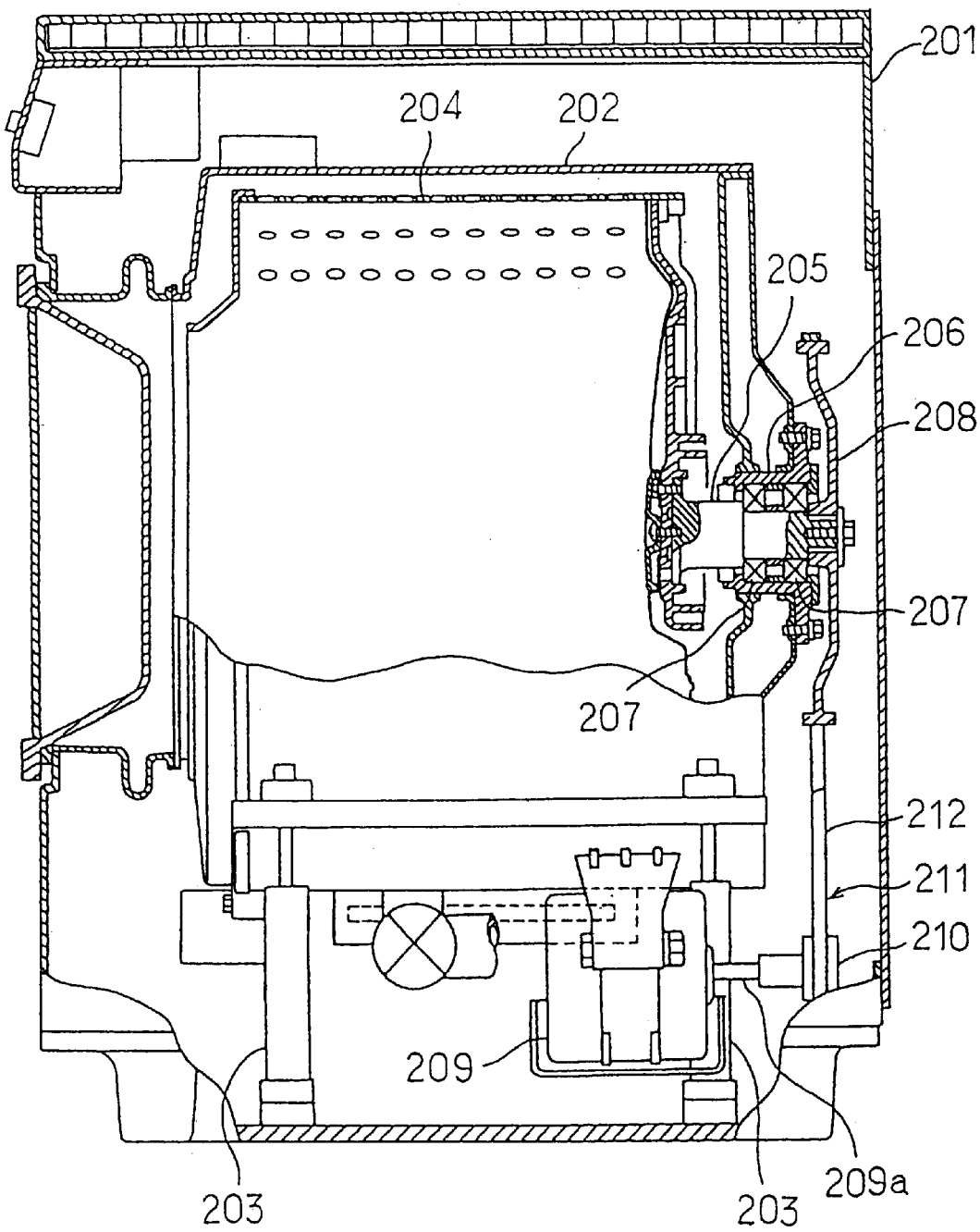
FIG. 17 PRIOR ART
FIG. 17 is a longitudinally sectional side view of a conventional drum type washing machine.

FIG. 16 illustrates a fifth embodiment of the invention. Only the difference between the fourth and fifth embodiments will be described. The front end plate 7 which is the same as that employed in the first embodiment is mounted on the front end of the body 5 of the water tub 3. The bellows 151 connect the opening 7*a* of the front end plate 7 to the access opening 2*a* of the outer cabinet 1. The bellows 151 have a width larger in its upper portion than in its lower portion according to the distance between the access opening 2*a* and the opening 7*a*. The bellows 151 have a hot air exhaust hole 153 formed through an upper portion thereof, and a frame 154 is mounted on the upper portion of the bellows 151 to reinforce the hot air exhaust hole 153. The other construction in the fifth embodiment is the same as that in the fourth embodiment and accordingly, the same effect can be achieved from the fifth embodiment as from the fourth embodiment.

Although the motor 17 comprises the outer rotor type motor in the foregoing embodiments, an inner rotor type motor may be used as the motor 17, instead. Furthermore, the motor torque may be transmitted through a belt transmission mechanism to the rotating tub 10 in the fourth and fifth embodiments.

The water tub 3 has substantially the same inclination as the rotating tub 10 in the foregoing embodiments. However, the inclination of the water tub 3 may differ from that of the rotating tub 10, instead. In this case, the inclination of the water tub 3 may deviate slightly from the range of 10 to 20 degrees.

The regenerative braking is employed as the electric braking in the foregoing embodiments. However, a short-circuit braking may be carried out, instead. The switching elements 40*a* to 40*f* are controlled so that the windings 17*u*, 17*v* and 17*w* of the motor 17 are short-circuited in the short-circuit braking.

The inclination of the rotating tub 10 is set in the range of 10 to 20 degrees for improvement in the loading and unloading of laundry and for prevention of increase in the size of the outer cabinet 1. However, as shown in FIG. 10, even when the inclination of the tub 10 is 5 degrees, laundry can be put into and taken out of the tub 10 easier than when the inclination is 0 degrees. Accordingly, the inclination of the tub 10 may be in the range of 5 to 20 degrees.

The door 9 has the same inclination as the inclined face 143 in the fourth and fifth embodiments. However, the inclination of the door 9 may differ from that of the inclined face 143, instead. Further, the overall front panel 2 may be inclined. Additionally, only the door 9 or only the front panel 2 of the front of the outer cabinet 1 may be inclined.

INDUSTRIAL APPLICABILITY

As obvious from the foregoing, the drum type washing machine of the present invention can be used in a relatively quiet environment since an amount of oscillation and an amount of noise are reduced while laundry is easily put into and taken out of the tub.

What is claimed is:

1. A drum type washing machine comprising:

an outer cabinet including a front having a front panel with a laundry access opening therein and a door provided on the front panel to close and open the access opening the front of the cabinet being inclined at an angle relative to a vertical axis;

a water tub provided in the cabinet;

a rotating tub provided in the water tub so as to be inclined rearwardly downward so that the inclination angle of the front of the cabinet is smaller than an inclination angle of a front of the rotating tub relative to the vertical axis; and an electric motor provided on a rear wall of the water tub for directly driving the rotating tub.

2. A washing machine according to claim 1, wherein the motor is of an outer rotor type.

3. A washing machine according to claim 1, wherein the rotating tub has an axis of rotation inclined in an angular range of 10 to 20 degrees relative to a horizontal axis.

4. A washing machine according to claim 1, further comprising an opening operation detecting element detecting opening of the door and a controller for operating an electric brake for stopping the motor, the controller stopping the motor.

5. A washing machine according to claim 1 further comprising an operation controller controlling execution of a washing operation, and a switch for indicating execution of the washing operation, wherein the operation controller prohibits execution of the washing operation until the switch is operated when the door has been opened after start of the washing operation.

6. A washing machine according to claim 1, wherein the water tub is inclined rearwardly downward, and wherein the washing machine further comprises a drain pump for draining the water tub, the drain pump being disposed below a front lower portion of the water tub in the cabinet.

7. A washing machine according to claim 1 wherein the front panel of the cabinet has a smaller inclination than that of the front of the rotating tub relative to a vertical axis.

8. A washing machine according to claim 1 wherein the front of the cabinet is constructed and arranged so that it has an inclination that is smaller than that of the rotating tub by at least 2 degrees and is in a range of 3 to 15 degrees.

9. A washing machine according to claim 1 wherein the front panel of the cabinet includes a portion located lower than the access opening and constructed and arranged to form a vertical face.

10. A drum type washing machine comprising:

an outer cabinet;

a water tub provided in the cabinet so as to be inclined rearwardly downward, the water tub having a rear wall;

a rotating tub provided in the water tub so as to be inclined rearwardly downward;

an electric motor provided on the rear wall of the water tub for directly driving the rotating tub; and a dryer provided for drying laundry in the rotating tub and including a blower disposed at a back of the upper rear wall of the water tub in the cabinet.

11. A drum type washing machine comprising:

an outer cabinet having a front including a front panel having a laundry access opening and a door provided on the front panel to close and open the access opening, the front of the cabinet being inclined at an angle relative to a vertical axis;

a water tub provided in the cabinet;

a rotating tub provided in the water tub so as to be inclined rearwardly downward so that the inclination angle of the front of the cabinet is smaller than an inclination angle of a front of the rotating tub relative to the vertical axis; and an electric motor driving the rotating tub.

12. A washing machine according to claim 11, wherein an inclination of the front panel of the cabinet relative to a vertical axis is smaller than an inclination of the front of the rotating tub.

13. A washing machine according to claim 11, wherein the front of the rotating tub has an inclination angle in the range of 5 to 20 degrees and the front of the cabinet has an inclination angle that is smaller than that of the rotating tub by at least 2 degrees and is in the range of 3 to 15 degrees.

14. A washing machine according to claim 11, wherein the front panel of the cabinet includes a portion located lower than the access opening and formed into a vertical axis.

15. A washing machine according to claim 11, wherein the water tub includes a cover constituting the front of the water tub and the washing machine further includes a dryer for drying laundry in the rotating tub, the dryer including a hot air generator for generating hot air, and wherein the water tub is inclined rearwardly downward and the water tub cover has an air supply port through which the hot air is supplied from the hot air generator into the rotating tub.

16. A washing machine according to claim 11, further comprising bellows connecting the laundry access opening and an opening of the water tub and a dryer for drying laundry in the rotating tub, the dryer including a hot air generator for generating hot air, and wherein the water tub is inclined rearwardly downward and the bellows have an air supply port through which the hot air is supplied from the hot air generator into the rotating tub.

* * * * *